US005368087A

United States Patent [19]

Rinz et al.

[11] Patent Number: 5,368,087

[45] Date of Patent: Nov. 29, 1994

[54] HOT BOX CORE MAKING APPARATUS

[75] Inventors: William J. Rinz, Akron; Tirlochan S. Sandhu, Strongsville, both of Ohio

[73] Assignee: Ford Motor Company, Dearborn, Mich.

[21] Appl. No.: 172,995

[22] Filed: Dec. 27, 1993

[51] Int. Cl.[5] ..... B22C 7/06; B22C 9/12

[52] U.S. Cl. ..... 164/228; 164/234

[58] Field of Search ..... 164/228, 234, 12, 16

[56] References Cited

U.S. PATENT DOCUMENTS

| | | | |
|---|---|---|---|
| 2,771,648 | 11/1956 | Valyi . | |
| 2,976,589 | 3/1961 | Hackett et al. | 164/12 |
| 3,416,593 | 12/1968 | Hathorn | 164/234 |
| 3,442,320 | 5/1969 | Hathorn | 164/228 X |
| 3,458,613 | 7/1969 | Andrews et al. . | |
| 3,587,709 | 6/1971 | Miller et al. . | |
| 4,047,882 | 9/1977 | Morita . | |
| 4,112,515 | 9/1978 | Sandon . | |
| 4,158,381 | 6/1979 | Michelson . | |
| 4,203,482 | 5/1980 | LeBlanc . | |
| 4,232,726 | 11/1980 | Michelson . | |
| 4,312,397 | 1/1982 | Harris et al. . | |
| 4,566,521 | 1/1986 | Uzaki et al. . | |
| 4,573,522 | 3/1986 | Merrien et al. | 164/12 X |
| 4,628,983 | 12/1986 | Myers et al. . | |
| 4,830,082 | 5/1989 | Bellis et al. . | |

FOREIGN PATENT DOCUMENTS

| | | | |
|---|---|---|---|
| 0257166 | 3/1988 | European Pat. Off. | 164/228 |
| 60-170557 | 9/1985 | Japan . | |
| 1-127139 | 5/1989 | Japan | 164/12 |
| 1050807 | 10/1983 | U.S.S.R. | 164/228 |
| 1058705 | 12/1983 | U.S.S.R. | 164/228 |
| 1521519 | 11/1989 | U.S.S.R. | 164/228 |
| 1051807 | 1/1990 | U.S.S.R. | 164/228 |

*Primary Examiner*—J. Reed Batten, Jr.

*Attorney, Agent, or Firm*—Joseph W. Malleck; Roger L. May

[57] ABSTRACT

A core box has a thick walled cope and a thin walled metal drag mating in essentially a horizontal parting plane. The cope and drag each have ports therethrough screened to prevent passage of sand, the ports communicating with the interior of the core box. Resilient seals seal and reseal the cope and drag at the parting plane. A convection heater delivers a heated gas, to drag ports and thence out through the ports of the cope, the convection heater having a heat conductive manifold attached to and along the drag for augmenting the heat of the gas as it passes to the ports of the drag. Conduction heater (burner units) directly heats both the cope and manifold and thereby the interior of the core box by conduction. The convection heater heats the gas in two stages, first to a temperature level outside the core box and manifold and thence to a second temperature level elevated by exposure to the manifold. The temperature levels are respectively about 175°-225° F. and 250°-290° F.

12 Claims, 3 Drawing Sheets

HOT BOX CORE MAKING APPARATUS

BACKGROUND OF THE INVENTION

1. Technical Field

This invention relates to sand core making by hot box techniques, and more particularly to full curing of such cores within the hot box before removing the core.

2. Discussion of the Prior Art

There are two basic methods using resin bonded sand in cores, the cores being used in subsequent metal casting operations. First there is the cold box core making method in which polyurethane resin binders are mixed with the sand and the mixture cured by infusion of catalyst gases into the core box to polymerize the binder. Secondly, there is the hot box core making method which uses a starting sand mixture comprised of resin binder and a liquid catalyst, the mixture being blown into the interior of the core box and then triggered to polymerize by the use of exteriorly applied heat. Heat is conducted from the outer regions of the sand core to the interior regions and although the curing action takes place at temperature as low as 120° F., it is necessary to achieve temperatures of 450° to 550° F. to stimulate proper polymerization of the sand core within a short period of time, such as 20 to 40 sec. (depending upon size and shape of core). The sand cores must be removed prematurely from the core box possessing only a fully cured outer skin with a partially cured interior core which must be fully cured in a separate independent core furnace, if required. Only in this manner has the hot box core making method been adopted to rapid high volume production. The exterior applied heat is provided by gas burners impinging on the box, often possessing flame temperatures of about 1600° F. Because the heat is so intense, large massive sand cores can only be cured rapidly to a very shallow skin depth, ¼ to ½ inch deep, while the rest of the core remains uncured. There is a high risk of damage and distortion in moving such cores to and during subsequent furnace curing (post curing). In both stages of curing, heat is transferred from the surface of the core to its center by conduction only. As sand is a good insulator, the process is energy intensive. Hot box cores continue to cure after they are removed from the core box due to exothermic reaction. Formaldehyde, a product of the curing reaction, is given off directly to the manufacturing area. Also, there is a tendency for excessive core box temperatures to burn the cores at the surface and thereby cause scrap.

In spite of such drawbacks, hot box core making is desirable because of its low cost, potential for high productively, and the relative quality of the cores in high volume production. To make such technology even more efficient, it would be desirable to quickly carry out complete curing of the sand cores within the hot core box prior to removal of the core, such as by convection heating in addition to conductive heating. Conventional hot box designs present three obstacles to providing a solution to this problem: (i) to introduce heat more rapidly and uniformly through the depth of the core, such as by convection heating, the box must be sealed; boxes do not contain resilient sealing today because of the very high heat of burner impingement directly on the metal core box; (ii) core boxes for large massive cores must be horizontally parted because of the need to extract the core, without damage, by giving support in at least to the lower part during removal, but such parting interferes with convection heating as well as with surrounding burners; and (iii) the adhesion between the sand core and the hot box, after treating, necessitates the use of mechanical ejector pins carried by movable plates, such ejector pins presenting additional sealing problems if convection heating is to be used.

SUMMARY OF THE INVENTION

It is an object of this invention to provide a hot box apparatus that overcomes the above problems in an economical and productive manner. Pursuant to this object, the invention is a hot box core making apparatus, comprising: (a) a core box having a thick walled metal cope and a thin walled metal drag, the cope and drag mating at essentially a horizontal parting plane, the cope and drag each having its walls perforated by ports filtered against sand and communicating with the interior of the box, the box defining an interior having a lateral dimension greater than its height; (b) a resilient seal that seals and reseals the cope and drag at the parting plane; (c) a convection heater delivering heated gas to the ports of only the drag for migration upwardly through the box interior and out through the cope ports, the convection heating means having a metal manifold attached only to and along the drag, the manifold having an expansion chamber facilitating the delivery of the gases to the drag ports; and (d) a conduction heater directly heating the cope and manifold and thereby the interior of the core box by conduction.

Convection heating is staged so that the convection gases are heated in an independent heater to a first level of temperature and then additionally raised in temperature as the gases migrate through the manifold before entering the drag ports. Resilient sealing preferably employs one or more resilient gaskets carried in grooves extending around the box interior. Ejection pins are used to remove the cured core and extend through the manifold but seal within the manifold when not ejecting.

DETAILED DESCRIPTION AND BEST MODE

Figure 1:
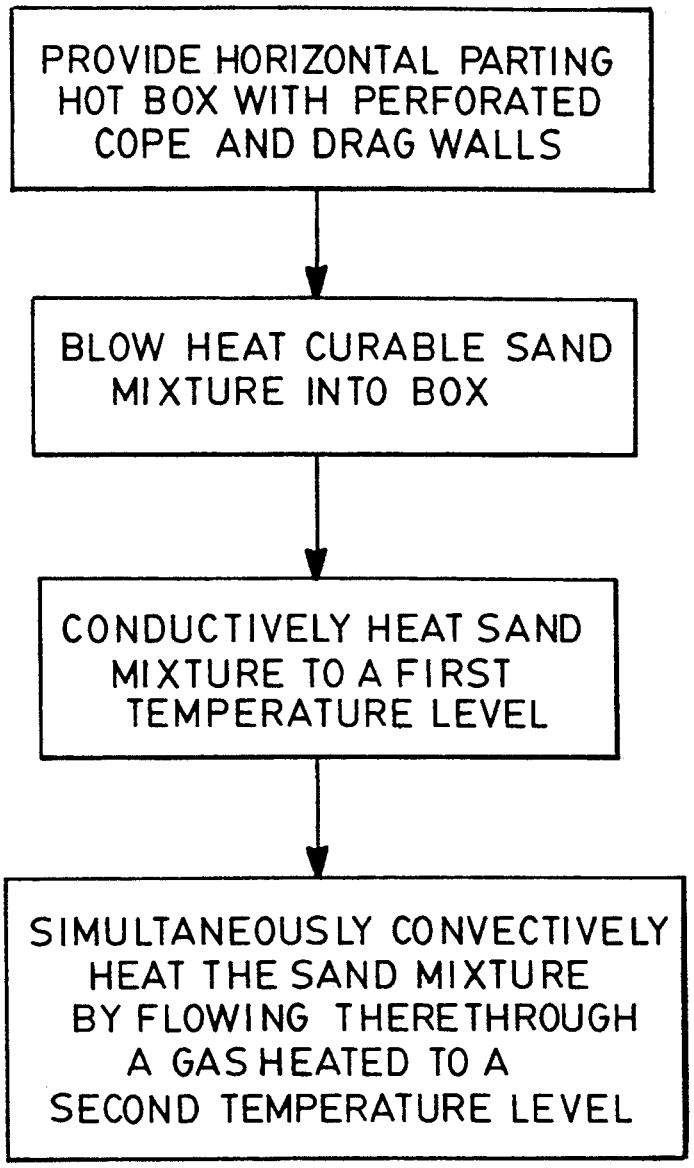
FIG. 1 is a flow diagram of the process for making sand cores employing the hot box apparatus of this invention.
Figure 2:
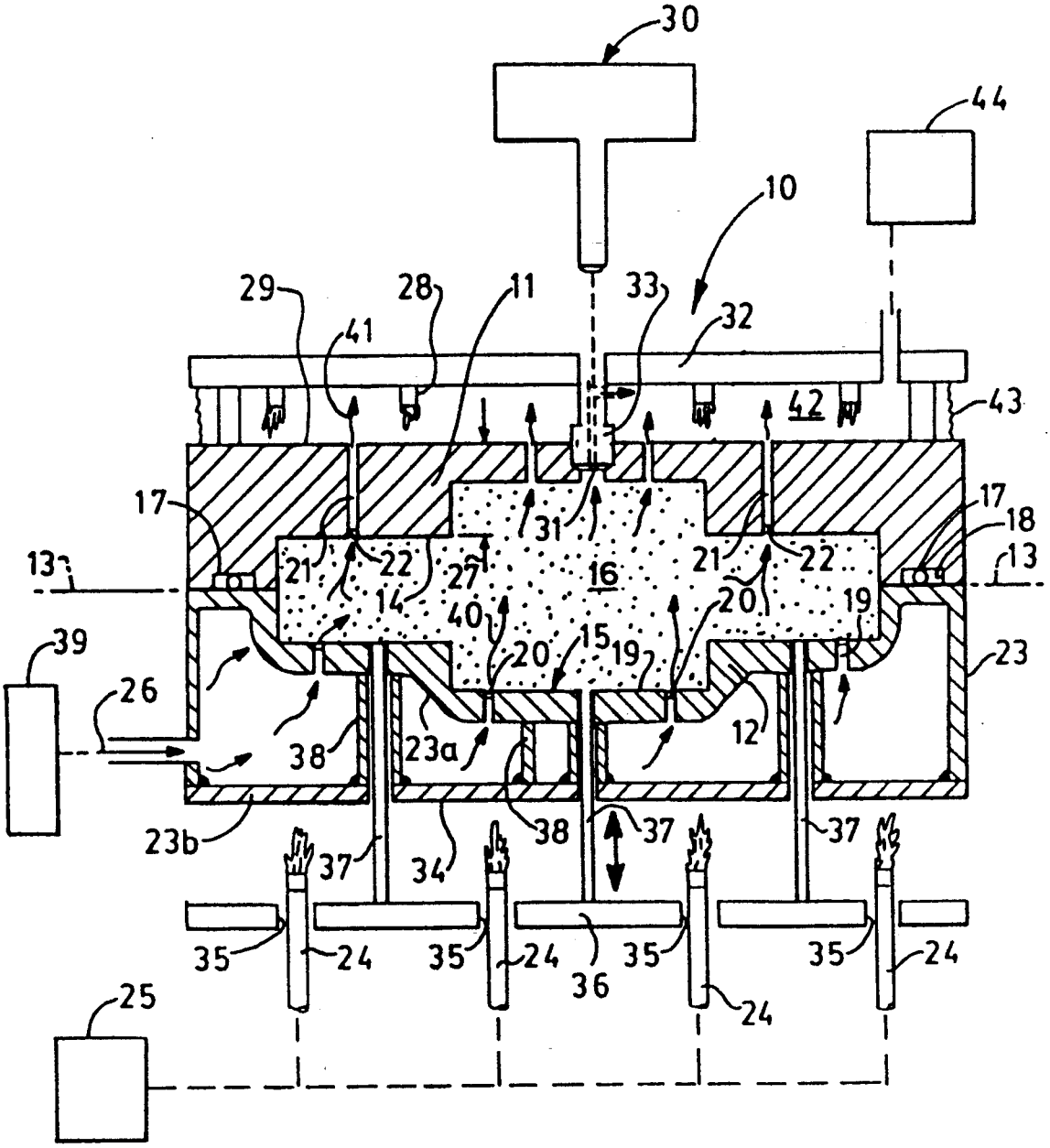
FIG. 2 is a sectional elevational view of a hot box apparatus design embodying the principles of this invention.

As shown in FIG. 1, the first step of the core making process is to provide a horizontal-parting hot box with perforated cope and drag walls. As shown in FIG. 2, the hot box 10 has a cope 11 and drag 12 mating at the plane 13; the cope and drag have core defining walls 14, 15 respectively defining an interior space 16 when mated. The cope and drag are made of a thermally conductive material such as cast iron or aluminum. A continuous resilient seal 17 is contained in at least one groove 18 extending around the interior 16 to define a sealing means. The interior space defines the shape of the core and for purposes of this invention, has an aspect ratio greater than one thus necessitating the need for a horizontal parting plane. The range of sand core aspect ratio sizes enabled by this invention is one to six.

The steps of wall 15 of the drag have ports or perforations 19 at predetermined spacings along the lateral extent of the core. Each port 19 has a screen 20, or equivalent sand filtering element on the interior side of the port (each screen may have a mesh of about 70, depending on the particle size of the sand). Similarly the cope has stepped walls 14 with ports or perforations 21 at predetermined spacings along the lateral extent of the core body. Each cope port opening 21 has a screen 22 or equivalent sand filtering element on the interior side of the ports.

The drag 12 has an integral pressurized manifold 23 interposed between the series of gas burners 24 which in conjunction with a controlled fuel supply 25 defines a conductive heating means. The manifold permits the thickness of the drag wall 15 to be much thinner than that for the cope since direct impingement of burner flames has been removed. Such thinness also facilitates quick passage of heat to the gas or heated air 26 passing through the manifold. The cope wall 14 has a greater thickness 27 to withstand direct impingement of flames from gas burners 28 which impinge on the upper surface 29 of the cope. The greater thickness of the cope wall 14 and the interpositioning of manifold 23 at the bottom of the drag 12 limits the temperature of the core box at the parting plane 13 to about 400° F., thus enabling available seal materials to resist such temperature while maintaining resiliency. Examples of o-ring seal materials useful in such sealing means comprise silicon rubber and graphite compound. These materials have sufficient resiliency to seal under load ranging from 40,000 to 60,000 pounds force and reseal again at prolonged temperatures of 400°-500° F.

The next basic step of the method in FIG. 1 is to blow a heat curable sand mixture into the interior 16 of the core box such as by use of a blowing apparatus 30. The method will work with a variety of sands having varying acid demands between 2 and 40 and sands from various origins such as wedron, beneficiated lake and manley sands. Such blowing of sand is through a central conical opening 31 in the cope wall 14; the sand is blown into the space 16 at a pressure of about 90 psi. The sand mixture contains an exothermic resin liquid which is activated by heat such as at an initial threshold level of at least about 175° F.; the resin may be a furan type containing a phenol-formaldehyde base modified with urea or a furfuryl type containing urea-formaldehyde material modified with furfuryl alcohol. Formaldehyde is reduce to levels of 0.1-0.7 ppm. The resin is present in an amount of 1.25-2.0% (based on sand weight). In addition to the resin, the sand mixture may contain a proprietary amount of liquid catalyst, approximately 20% (based on binder weight). The activator or catalyst in the mixture is a liquid that is temperature activated. The heat producing resin system will eventually form a small amount of water and cured resin as a result of the application of heat hereto. Typical sand mixtures consists of 1.25-2.0% resin binder (based on sand weight) and approximately 20% liquid catalyst (based on binder weight).

When the interior is completely filled with the proper amount of sand mixture, the blowing apparatus 30 is removed and replaced with a stripper plate 32 carrying a blow tube plug 33 effective to seal against the conical surface of opening 31. The stripper plate is moved to insert the plug 33 into the blow hole 31 closing off such hole.

The third step of the process of FIG. 1 is to conductively heat the sand mixture in the core box to a first temperature level such as about 250° F. To this end the conductive heating means comprises a plurality of gas burners 24 which are spaced and directed to impinge burner flames directly on the lower surface wall 34 of the manifold 23 to create a uniform heating of such wall. Similarly, gas burner units 28 are fixed to the stripper plate 32 and depend therefrom to impinge gas flames on the upper surface 29 of the cope. The gas burners 28 ride up and down with the movement of the stripper plate. The gas burners 24 protrude loosely through access openings 35 in the ejector plate 36 which carries a plurality of ejector pins 37; the pins pass not only through the manifold 23 but through the wall 15 of the drag. The ejector pins are sufficient in number to impart a small removal force to the cured core when removed from the core box. To enhance the conduction of heat from the gas burners impinging on the lower surface 34 of the manifold 23, solid conductors 38 may be implanted as rods or fins between the upper side **23*a* and the lower side 23*b*** of the manifold to more readily carry heat therebetween.

The basis for the chemical process is: furfuryl alcohol resin, phenolic resin, or a mixture of furan and phenolic-+acid salt catalyst+450° to 550° F. =cured resin+water.

Hot box binders cure uniquely. After the sand has been coated, it is blown into a heated corebox. The "wet mix" begins to cure as soon as it comes into contact with the hot pattern. At temperatures over 120° F., the acid salt catalyst decomposes. A weak acid is formed that causes the resin to polymerize via an exothermic condensation reaction that generates water as it proceeds. At normal pattern operating temperatures (450° to 550° F.) the core will form a cured, hardened skin starting at the rate of about 1/16 in. per 5 sec. Once the sand temperature goes above 120° F. and approaches that of the heated pattern, the catalyst decomposes and cures the resin quickly. The cure continues to completion or until the temperature of the sand drops back to below the 120° F. critical cure temperature.

Liquid catalyst selection normally is based on the acid demand value (ADV) and other chemical properties of the sand. An ambient temperature change of 20° F. and/or variations of plus or minus 5 units in the ADV of the sand probably call for some type of a catalyst adjustment. Resin manufacturers need only a few basic types of resins, but many different catalysts are used to contend with the temperatures, sand chemistry, and other changes that occur.

The weak acid salt catalyst are either granular or water solutions of urea and ammonium chloride or ammonium nitrate in combination with small amounts of modifiers. A granular catalyst offers precise control of the process because the amount of chloride can be adjusted independently of the water and buffers that accompany the active ingredient in the water-borne systems. In addition, the chloride/urea ratio can be tailored by the manufacturer to provide a stronger or weaker catalyst.

Conventional hot box resins are classified simply as furan or phenolic types. The furan types contain furfuryl alcohol, the phenolic types are based on phenol, and the furan-modified phenolic of course has both. All conventional hot box binders contain urea and formaldehyde. The furan hot box resin has a fast "front-end" cure compared to that of the phenolic-type system and therefore can be ejected from the corebox faster. Furan resin also provides superior shakeout and presents fewer disposal problems. Typical resin content is 1.5 to 2.0%.

Conventional hot box resins contain 4 to 10% free formaldehyde and 6 to 13% nitrogen (the catalyst contains 15 to 25% nitrogen). The formaldehyde odor is irritating and is most apparent at the core making station. The nitrogen, which is present in a form of ammonia, is known as "ammoniacal nitrogen" because each nitrogen atom is attached chemically to three atoms of hydrogen. Many foundries have high-velocity exhaust hoods built over the core belts to carry away fumes and to cool cores so that they can be handled and stored easily. In effect, such rapid cooling shortens the cure cycle. A lower-velocity exhaust system still can carry away the fumes, but will not cool the cores too quickly. This invention reduces or eliminates the need for such high velocity exhaust hoods.

The fourth step of the basic process in FIG. 1 is to simultaneously convectively heat the sand mixture in space 16 by flowing therethrough a gas (such as air) heated to a second temperature level such as 250°–290° F. To this end, convection heating means comprises a remote heating device 39 effective to raise a gas or air supply to a first stage temperature such as 175° F., and to deliver such first stage heated gas to the interior of manifold 23 to allow such heated gas to further absorb heat from the manifold during its temporary residency therein. This causes the gas to be heated to a second level such as 250°–290° F. for introduction into the sand core. The gas flow 40 migrates from the lower portion of the core upwardly therethrough and out through the ports 21 of the cope. The period of gas flow through the core mixture in the core box varies from 20 to 50 seconds. The pressure of such convention heating flow should be proportioned to the largest thickness of the sand core through which the gas must migrate. For example, for a one inch thick section, the pressure should be about 10–11 psi.

The emissions 41 that exit from the ports 21 are trapped and collected within a space 42 enclosed by the stripper plate 32 and bellows or bonnet 43 surrounding the outer edges of the stripper plate and cope. Thus, the emissions are collected and conducted to a fume collection system 44. The bellows or bonnet may be constructed of a flexible ceramic cloth which resists temperatures up to 600° F. maximum. The emissions will generally contain formaldehyde in a concentration range of 0.1 to 0.75 ppm. By trapping such emissions the odor level of the ambient air about the process station is substantially reduced after core box opening and there is no post-baking required.

Figure 3:
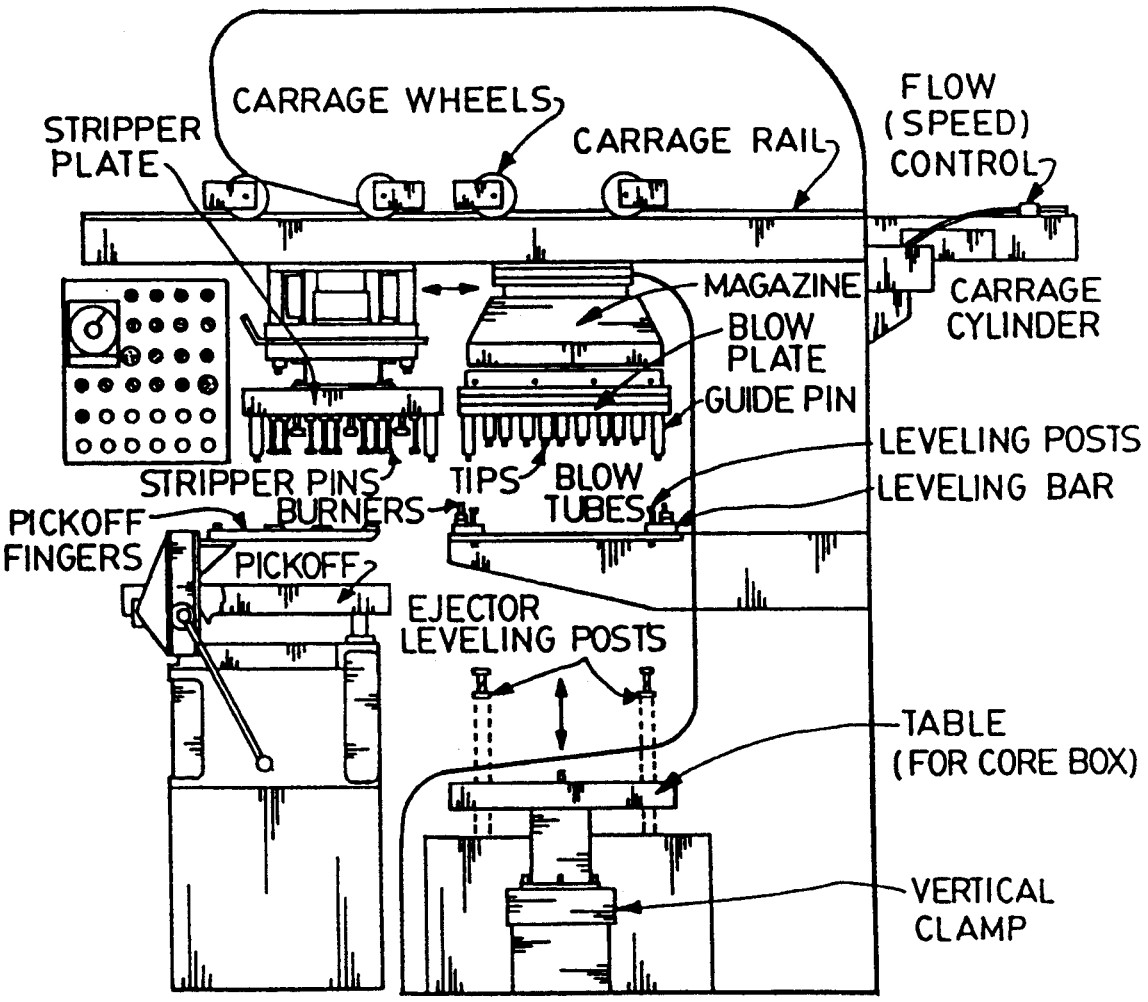
FIG. 3 is a elevational view of a device for using the core box during the core making cycle.

FIG. 3 shows an apparatus for manipulating the blowing apparatus (blow plate), stripper plate table for core box. The core box moves vertically up and down, whereas the blow plate and stripper plate move horizontally during the core blowing and curing cycle. Further use of the apparatus of FIG. 3 is apparent from the disclosure in U.S. Pat. No. 4,158,381.

What is claimed:

1. A hot box core box making apparatus comprising:

(a) a core box having a thick walled cope and a thin walled metal drag mating in essentially a horizontal parting plane said cope and drag each having ports therethrough screened to prevent passage of sand, the ports communicating with the interior of the core box;

(b) one or more resilient seals that seal and reseal said cope and drag at said parting plane;

(c) convection heater delivering a heated gas, to said drag ports and out through the ports of said cope, said convection heater having a heat conductive manifold attached to and along said drag for augmenting the heat of said gas as it passes to said ports of the drag; and (d) conduction heater directly heating both said cope and said manifold and thereby the interior of said core box by conduction.

2. The apparatus as in claim 1, in which said conduction heater comprises a plurality of burner units with flames impinging directly on said manifold and on said cope.

3. The apparatus as in claim 1, in which said convection heater heats said gas in two stages, first to a temperature level outside said core box and manifold, and thence to a second temperature level elevated by exposure to said manifold.

4. The apparatus as in claim 3, in which said gas is air and said temperature levels are respectively about 175°–225° F. and 250°–290° F.

5. The apparatus as in claim 1, in which said core box additionally comprises an ejector plate and ejector pins on said plate effective to extend through said manifold and drag to urge the removal of a core when properly cured.

6. The apparatus as in claim 5, in which said ejector pins have a conical surface for mating with a complementary conical surface of the drag for creating a seal during non-ejection.

7. The apparatus as in claim 1, in which the thickness of the cope is in the range of 2 to 3 inches, and is greater than the thickness of said drag wall by a factor of about 1.5.

8. The apparatus as in claim 1, in which said conductive heater comprises conductor fins or pins extending through the manifold to enhance conduction of heat.

9. The apparatus as in claim 1, in which said ports in said cope and drag are arranged to allow for migration of the heated gas only from said drag through a sand core within the core box and thence out through said cope.

10. The apparatus as in claim 1, in which said convective heater is effective to deliver heated gas at a pressure in the range of 5 to 100 psi and which is proportional to the thickness of a sand core within the core box.

11. The apparatus as in claim 1, in which the convective heater comprises a fume collector surrounding the exit ports of the cope to entrain emissions therefrom.

12. The apparatus as in claim 11, in which said fume collector comprises a stripper plate surrounded by a flexible high temperature bonnet.

* * * * *